United States Patent [19]

Holt

[11] 4,103,661

[45] Aug. 1, 1978

[54] DIESEL ENGINE STARTING SYSTEMS

[75] Inventor: William David Holt, Cologne, England

[73] Assignee: Lucas Industries Limited, Birmingham, England

[21] Appl. No.: 762,643

[22] Filed: Jan. 26, 1977

[30] Foreign Application Priority Data

Jan. 30, 1976 [GB] United Kingdom ..... 3678/76

[51] Int. Cl.[2] ..... F02N 17/00

[52] U.S. Cl. ..... 123/179 H; 123/179 B

[58] Field of Search ..... 123/179 B, 179 H

[56] References Cited

U.S. PATENT DOCUMENTS

| | | | |
|---|---|---|---|
| 1,269,637 | 6/1918 | Olmsted | 123/179 H |
| 3,371,656 | 3/1968 | Stauffer et al. | 123/179 H |
| 3,551,686 | 12/1970 | Koehler | 123/179 H |
| 3,675,033 | 7/1972 | Richard et al. | 123/179 H |

FOREIGN PATENT DOCUMENTS

| | | | |
|---|---|---|---|
| 2,300,229 | 3/1976 | France | 123/179 H |
| 2,225,662 | 5/1972 | Fed. Rep. of Germany | 123/179 H |
| 2,360,841 | 6/1975 | Fed. Rep. of Germany | 123/179 H |
| 1,299,589 | 12/1972 | United Kingdom | 123/179 H |

*Primary Examiner*—Charles J. Myhre
*Assistant Examiner*—David D. Reynolds
*Attorney, Agent, or Firm*—Holman & Stern

[57] ABSTRACT

A control circuit for a diesel engine starting system including an air intake heating starting aid and a fuel preheater, includes a first delay circuit for operating the preheater and a second delay circuit for operating an indicator. A selector switch has an off position in which the two delay circuits are not utilized, a first on position in which the first delay circuit is overridden and the indicator carries on after a delay determined only by the second delay circuit, and a second on position in which the first delay circuit operates to switch on the fuel preheater after a delay during which the starting aid device is operating and the second delay circuit turns on the indicator after a further delay.

5 Claims, 1 Drawing Figure

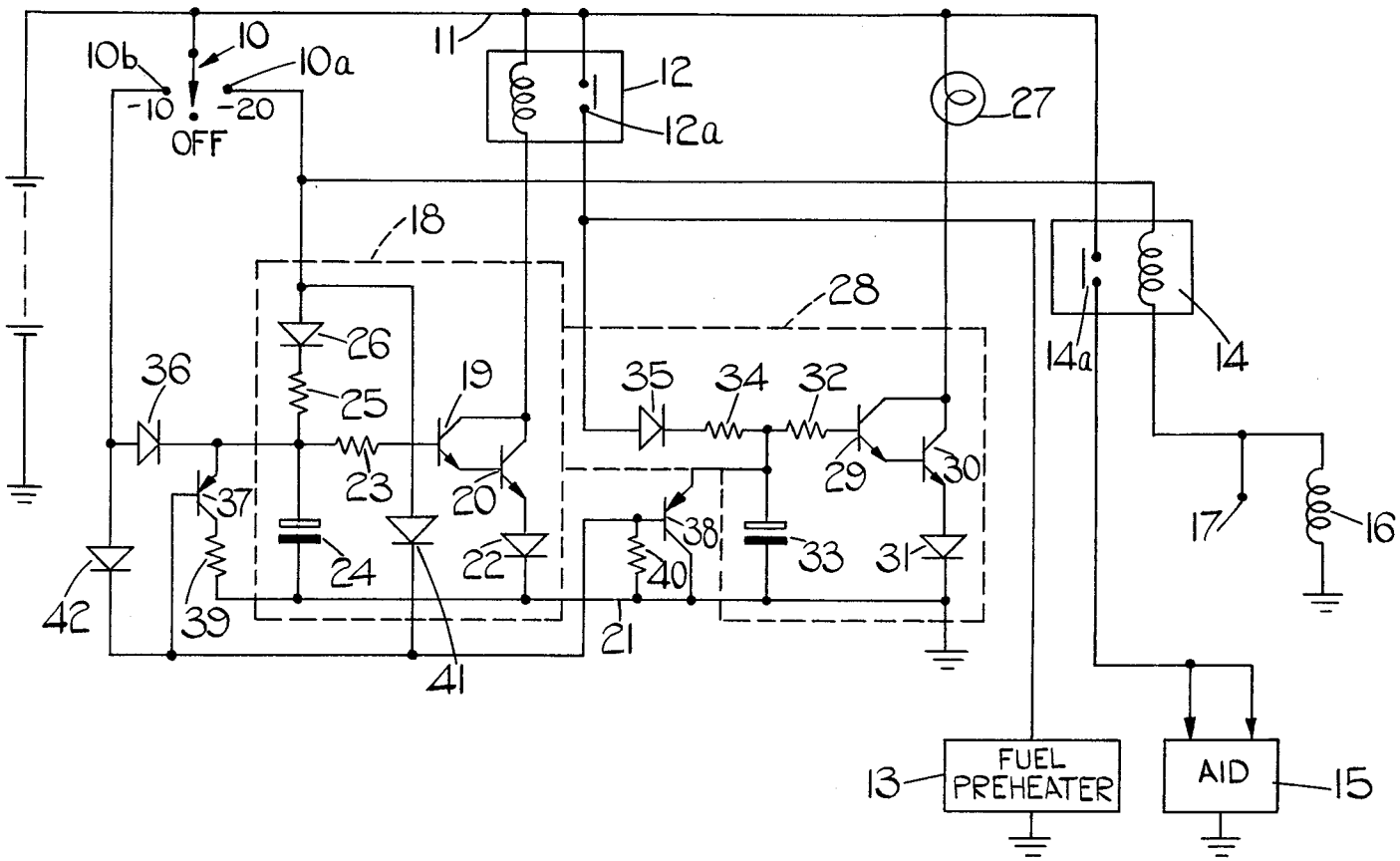
AID
FUEL PREHEATER
OFF
-20
-10

DIESEL ENGINE STARTING SYSTEMS

It is known to provide various starting aids for diesel engines to assist starting in low temperature conditions. Firstly it is known to use a device which heats the air intake manifold or combustion chamber of the engine and such a device will be referred to hereinafter as a "starting aid device." Secondly it is known to use a heater device for preheating the fuel and air mixture which is to be supplied to the engine, and such a device is referred to hereinafter as a "fuel preheater device."

The object of the present invention is to provide a control circuit for use in a diesel engine starting system which includes both a starting aid device and a fuel preheater device.

According to the invention there is provided a control circuit for a diesel engine starting system including a starting aid device and a fuel preheater device, said circuit comprising a selector switch having an off position and first and second on positions, a first delay circuit for operating the fuel preheater device, a second delay circuit for operating an indicator to indicate when cranking of the engine can be commenced, and means for operating the starting aid device when the selector switch is moved to its first on position, the devices being so connected to the delay circuits that when the switch is moved to its first on position there is a first delay before the fuel preheater device is operated and a second delay before the indicator is operated, but when the switch is moved to its second on position, there is no delay before the fuel preheater device is operated and only said second delay elapses before the indicator is operated.

An example of the invention is shown in the accompanying drawing which is the circuit diagram of a starting system.

The circuit shown includes a selector switch 10 which has an off position in which it is shown and first and second on positions in which it connects a positive supply rail 11 to contacts 10*a* and 10*b* respectively. A relay 12 is provided with normally open contacts 12*a* through which a fuel preheater device 13 is connected between the rail 11 and earth. A further relay 14 has normally open contacts 14*a* connecting a starting aid device 15 between the rail 11 and earth.

The winding of relay 14 is connected in series with a starter motor field winding 16 between the contact 10*a* and earth and is arranged so that it is de-energised when the starter field supply is connected to a terminal 17 when cranking of the engine is commenced.

The winding of the relay 12 is connected in the output of a first delay circuit 18. This delay circuit 18 includes an n-p-n Darlington pair 19, 20 with the emitter of the output transistor thereof grounded to an earth rail 21 via a diode 22. The collector of the output transistor 20 is connected via the winding of relay 12 to the supply rail 11 and the base of the input transistor 19 is connected by a resistor 23 to one side of a capacitor 24 the other side of which is grounded to rail 21. Said one side of the capacitor 24 is connected via a resistor 25 and diode 26 in series to the contact 10*a*. The capacitor 24 and resistor 25 have a relatively long time constant so that when the switch is in its first on position it will take about 1 minute to charge the capacitor 24 sufficiently to turn on the Darlington pair and energise the relay 12.

An indicator lamp 27 is controlled by a second delay circuit 28. This delay circuit 28 comprises a Darlington pair 29, 30, with the emitter of the output transistor 30 grounded to the rail 21 via a diode 31 and its collector connected via the lamp 27 to the rail 11. The base of the input transistor 29 is connected via a resistor 32 to one side of a capacitor 33 the other side of which is grounded. Said one side of the capacitor 33 is connected by a resistor 34 and a diode 35 in series to the normally open contact 12*a* of the relay 12. The capacitor 33 thus charges up when the contact 12*a* closes and is chosen to provide a time constant such that it will charge up sufficiently to turn on the Darlington pair 29, 30 after about 30 seconds.

A diode 36 connects the contact 10*b* to said one side of the capacitor 24 so that the latter can charge rapidly when the switch 10 is in its second position.

A pair of p-n-p transistors 37, 38 are provided for discharging the capacitors 24, 33 respectively when the switch 10 is off. The transistor 37 has its emitter connected to said one side of the capacitor 24 and its collector connected by a resistor 39 to the rail 21. The transistor 38 has its emitter connected to said one side of the capacitor 33 and its collector connected to the rail 21. The bases of the two transistors 37, 38 are connected together and via a resistor 40 to the rail 21 to bias each transistor to conduct whenever there is any charge on the associated capacitor. Contacts 10*a* and 10*b* are respectively connected to the bases of the transistors 37 and 38 via diodes 41, 42 to turn the transistors 37, 38 off whenever the switch 10 is in either on position.

In use, when the first switch position is selected, there will be a delay of about two minutes before the relay 12 is energised. Meanwhile relay 14 is energised via the contact 10*a* and the field winding 16 to operate the starting aid device 15. At the end of this first delay the relay 12 energises the device 13 and also initiates a second delay of 30 seconds before the indicator 27 is illuminated. The driver of the vehicle then knows that he can operate the starter motor to crank the engine, which action will automatically de-energise the relay 14 to disconnect the heavy load on the battery represented by the device 15 during cranking.

On the other hand, in conditions of less severe cold, the driver may opt to use the device 13 only. In this case he moves the selector switch to its second position. This causes capacitor 24 to charge up and switch on the relay 12 substantially without any delay and the indicator 27 then comes on after 30 seconds.

I claim:

1. A control circuit for a diesel engine starting system including a starting aid device and a fuel preheater device, said circuit comprising a selector switch having an off position and first and second on positions, a first delay circuit for operating the fuel preheater device, a second delay circuit for operating for an indicator to indicate when cranking of the engine can be commenced, and means for operating the starting aid device when the selector switch is moved to its first on position, the devices being so connected to the delay circuits that when the switch is moved to its first on position there is a first delay before the fuel preheater device is operated and a second delay before the indicator is operated, but when the switch is moved to its second on position, there is no delay before the fuel preheater device is operated and only said second delay elapses before the indicator is operated, wherein said delay circuits comprise a resistor-capacitor delay network and a transistor controlled by the voltage on the capacitor, and a reset circuit for causing discharge of both capacitors when the switch is in its off position.

2. A control circuit as claimed in claim 1 in which the first delay circuit is arranged to operate a relay which, on operation brings into operation said fuel preheater device and also initiates operation of said second delay circuit.

3. A control circuit as claimed in claim 2 in which said first delay circuit includes a resistor-capacitor delay network fed from said switch in its first on position and a transistor for driving said relay and sensitive to the capacitor voltage.

4. A control circuit as claimed in claim 3 including a diode connection to said capacitor from said switch in its second on position so as to charge the capacitor rapidly.

5. A control circuit as claimed in claim 1 in which the reset circuit comprises a pair of further transistors with their emitter-collector paths across the capacitors and their bases connected together and, via a resistor, to one side of each said capacitor so that said transistors are biased thereby to conduct and diode means connecting said bases to the switch so that in either on position thereof said further transistors are turned off.

* * * * *